US006425728B1

(12) United States Patent
Goto

(10) Patent No.: US 6,425,728 B1
(45) Date of Patent: Jul. 30, 2002

(54) TILTING SPEED CONTROLLING APPARATUS AND METHOD FOR INDUSTRIAL VEHICLE

(75) Inventor: Tetsuya Goto, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 12 days.

(21) Appl. No.: 09/640,341

(22) Filed: Aug. 16, 2000

(30) Foreign Application Priority Data

Aug. 23, 1999 (JP) ..... 11-236021

(51) Int. Cl.[7] ..... B66F 9/22
(52) U.S. Cl. ..... 414/636
(58) Field of Search ..... 414/636, 642; 187/224

(56) References Cited

U.S. PATENT DOCUMENTS

| | | | | | |
|---|---|---|---|---|---|
| 4,411,582 | A | * | 10/1983 | Nakada | 414/636 |
| 4,520,443 | A | * | 5/1985 | Yuki et al. | 414/636 |
| 6,041,163 | A | * | 3/2000 | Cherry, Jr. | 388/811 |
| 6,125,970 | A | * | 10/2000 | Takeuchi et al. | 414/636 |
| 6,164,415 | A | * | 12/2000 | Takeuchi et al. | 414/636 |
| 6,350,100 | B1 | * | 2/2002 | Naruse et al. | 414/636 |

FOREIGN PATENT DOCUMENTS

| | | | | |
|---|---|---|---|---|
| EP | 0 866 027 A | | 9/1998 | B66F/9/22 |
| EP | 0 878 440 A | | 11/1998 | B66F/9/22 |
| GB | 2097959 | * | 11/1982 | 414/636 |
| GB | 2 099 184 A | | 12/1982 | B66F/9/24 |
| GB | 2 102 511 A | | 2/1983 | F04B/49/02 |
| JP | 58-12600 | * | 1/1983 | 414/636 |
| JP | 63-127999 | | 5/1988 | |
| JP | 3-73598 | * | 7/1991 | 414/636 |
| JP | 5-229792 | * | 9/1993 | 414/636 |
| JP | 6-15990 | * | 1/1994 | 414/636 |
| JP | 7-479 | * | 1/1995 | 414/636 |
| JP | 7-61792 | | 3/1995 | B66F/9/24 |
| JP | 8-12298 | | 1/1996 | |
| JP | 9-77495 | * | 3/1997 | 414/636 |
| JP | 10-273293 | | 10/1998 | |
| JP | 10-310394 | * | 11/1998 | 414/636 |
| JP | 11-92095 | * | 4/1999 | 414/636 |
| JP | 11-139796 | | 5/1999 | |
| JP | 2000-169099 | * | 6/2000 | 414/636 |
| WO | WO 99/16698 A | | 4/1999 | B66F/9/24 |

* cited by examiner

*Primary Examiner*—James W. Keenan
(74) *Attorney, Agent, or Firm*—Morgan & Finnegan, LLP

(57) ABSTRACT

A tilt speed control apparatus for fork lift comprises a mast pivotally supported on a body frame. A fork is supported by the mast. The fork is lifted and lowered and is constructed to carry a load. A pump sends hydraulic oil to a tilt cylinder. A motor drives the pump. A lever is actuated to tilt the mast. A controller detects that the lever has been actuated. The controller produces a signal relating to the height of the load carrier. When the controller detects that the lever has been actuated, the controller controls the motor according to the signal such that the speed of the motor is relatively low when the position of the fork is relatively high. This permits a tilting speed controlling apparatus that optimizes the tilting speed of the mast.

12 Claims, 3 Drawing Sheets

TILTING SPEED CONTROLLING APPARATUS AND METHOD FOR INDUSTRIAL VEHICLE

BACKGROUND OF THE INVENTION

The present invention relates to a tilting speed controlling apparatus in an industrial vehicle such as a forklift. More particularly, the present invention pertains to a control apparatus and method for controlling tilt cylinders, which tilt a mast that supports a load carrier. The load carrier can be lifted and lowered.

A typical industrial vehicle such as a forklift includes a mast pivotally supported on the front of the vehicle. The forklift also has a fork supported by the mast, which may be lifted and lowered. A tilt lever is provided in the cab. The operator manipulates the tilt lever to actuate tilt cylinders, which tilt the mast forward or rearward. Tilting of the mast facilitates loading and unloading and improves the stability of the vehicle while running.

When the mast is tilted forward, the rear wheels of the forklift must be prevented from losing contact with the road surface. That is, the stability of the vehicle must be guaranteed. Japanese Unexamined Patent Publication No. 7-61792 discloses an engine type forklift that maintains contact between the rear wheels and the ground. The forklift includes an electromagnetic valve that is located in an oil passage connected to a pair of tilt cylinders. The opening size of the electromagnetic valve is controlled in accordance with manipulation of the tilt lever, which controls the tilting speed of the mast.

When the weight of an object on the load carrier is greater than a predetermined value and the height of the load carrier exceeds a predetermined height, the apparatus limits the opening size of the control valve such that tilting speed of the mast is limited. That is, according to the weight of a carried object and the height of the load carrier, the tilting speed mode is switched between a normal tilting speed mode and a low tilting speed control mode. The apparatus thus prevents the rear wheels from losing contact with the road surface due to a high forward tilting speed of the mast.

A battery-powered forklift includes a pump, which is driven by an electric motor. The pump sends oil to a hydraulic circuit to actuate a lift cylinder and tilt cylinders. When a lift lever is manipulated, the motor is started and sends hydraulic oil to the lift cylinder and the tilt cylinders.

The tilting speed of the mast varies in accordance with the degree of movement of the tilt lever both in the normal tilting speed mode and the low tilting speed mode. However, the forklift of the publication has only two tilting speed modes. Thus, switching between the two modes may disturb the operator. Also, the tilting speed may be too slow, which lowers performance. Further, the tilting speed may be too fast, which prevents the mast from being finely controlled.

To avoid such disadvantages, one or both of the height of the load carrier and the weight of the carried object may be continuously monitored, and the tilting speed may be continuously changed in accordance with the change of the center of gravity of the mast. This requires that the opening size of the electromagnetic control valve be continuously changed in accordance with changes of the detected value, which complicates the control procedure.

Since the height of the load carrier and the weight of the carried object both need be detected, the forklift must include a height sensor and a load sensor. If the apparatus is installed in a battery-powered forklift, an extra electromagnetic control valve also needs to be installed, which complicates the control procedures and the structure of the forklift.

SUMMARY OF THE INVENTION

Accordingly, it is an objective of the present invention to provide a tilting speed controlling apparatus that optimizes the tilting speed of a mast.

To achieve the above objective, the present invention provides a tilt speed control apparatus for an industrial vehicle, the apparatus comprises a mast pivotally supported on a body frame. A load carrier is supported by the mast. The load carrier is lifted and lowered and is constructed to carry a load. A tilt cylinder tilts the mast. A pump sends hydraulic oil to the tilt cylinder. A motor drives the pump. An operating member is actuated to tilt the mast. An operating detector detects that the operating member has been actuated. A position detector produces a signal relating to the height of the load carrier. A controller controls the motor. When the operating detector detects that the operating member has been actuated, the controller controls the motor according to the signal such that the speed of the motor is relatively low when the position of the load carrier is relatively high.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A tilting speed controlling apparatus according to a first embodiment of the present invention will now be described with reference to FIGS. 1 to 3. The apparatus is used in an industrial vehicle, which is a battery-powered forklift in this embodiment.

Figure 1:
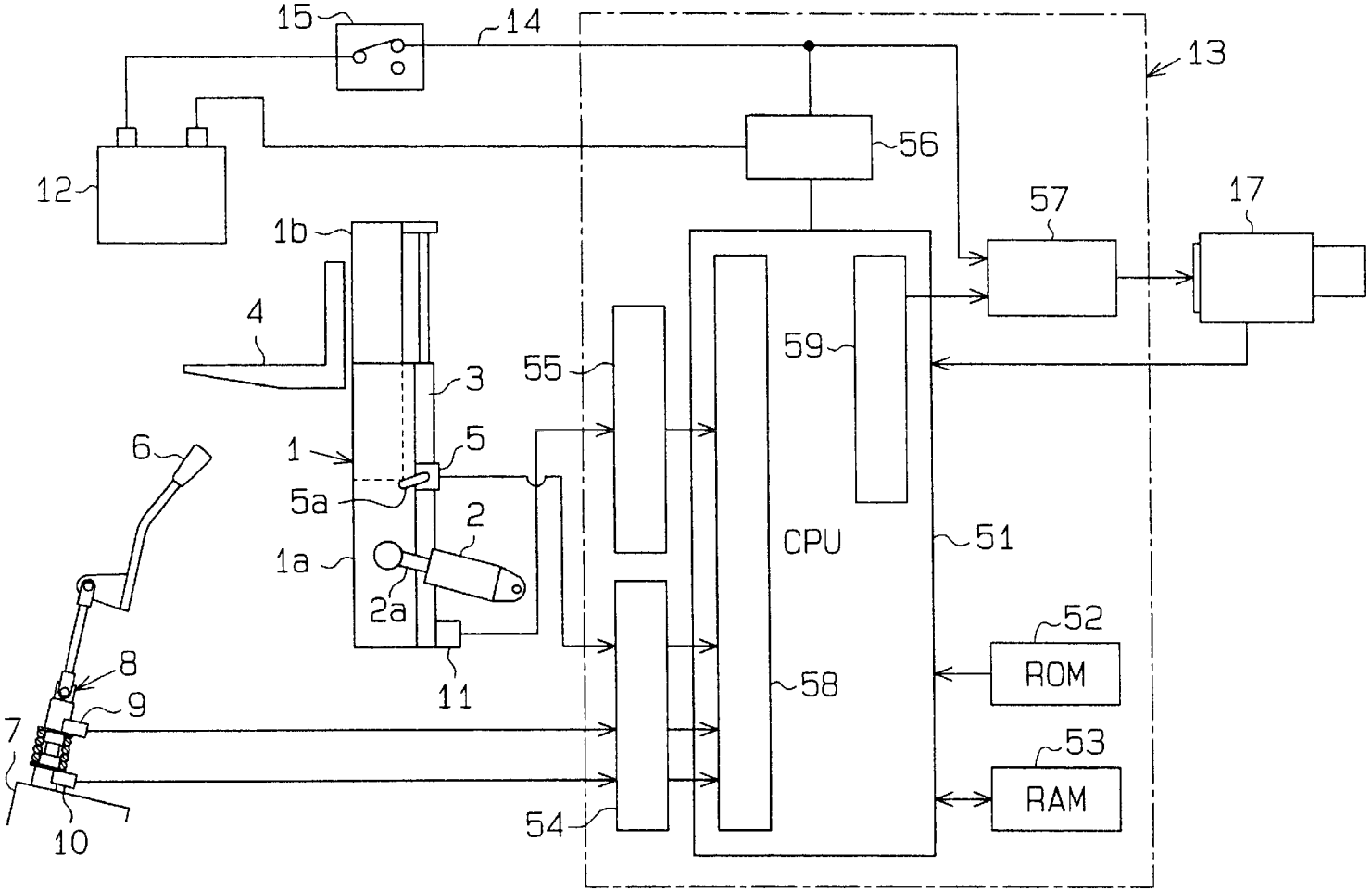
FIG. 1 is a block diagram showing the electric configuration of an apparatus according to a first embodiment of the present invention.

As shown in FIG. 1, the forklift includes a mast 1, which is arranged on the front of a body frame (not shown). The mast 1 is pivotally supported by the body frame. The mast is coupled to the body frame by tilt cylinders 2. The mast 1 is tilted forward and rearward by extending and retracting the tilt cylinders 2.

The mast 1 includes an outer mast 1*a* pivotally supported by the body frame and an inner mast 1*b* arranged inside the outer mast 1*a*. The inner mast 1*b* is lifted and lowered relative to the outer mast 1*a* by a lift cylinder 3. A pulley is supported by the inner mast 1*b* at the top end of the inner mast 1*b*. A chain is engaged with the pulley. One end of the chain is coupled to the outer mast 1*a*, and the other end is coupled to a fork 4 by a lift bracket (not shown). The fork 4 and the lift bracket are integrally lifted and lowered relative to the mast 1. When the lift cylinder 3 is extended, the fork 4 and the lift bracket are also lifted by the chain. A pair of tilt cylinders 2 couple the outer mast la with the body frame. The proximal end of each tilt cylinder 2 is coupled to the body frame and the distal end is coupled to a side of the outer mast 1*a*.

A height sensor 5 is located on the outer mast 1*a*. The height sensor 5 includes detector lever 5*a*. The detector lever 5*a* is generally horizontal and pivots relative to the sensor 5. The lever 5*a* engages the lower end of the inner mast 1*b*. When the lever 5*a* is pivoted downward by the inner mast 1*b*, the sensor 5 detects that the inner mast 1*b* is in a relatively low range of positions. When the lever 5*a* is not engaged by the inner mast 1*b*, the sensor 5 detects that the inner mast 1*b* is in a relatively high range of positions. The sensor 5 is turned on when the fork 4 is in the high range and is turned off when the fork 4 is in the low range.

A tilt lever 6 for tilting the mast 1 is provided in the cab. The tilt lever 6 is connected to a control valve 7 of a hydraulic system by a transmission mechanism, which is a link mechanism 8 in this embodiment. The tilt lever 6 has a forward tilt switch 9 and a rearward tilt switch 10. The forward tilt switch 9 detects forward tilting of the lever 6, and the rearward tilt switch 10 detects rearward tilting of the lever 6. The forward tilt switch 9 is turned on when the tilt lever 6 is tilted forward relative to a neutral position. The rearward tilt switch 10 is turned on when the tilt lever 6 is tilted rearward relative to the neutral position. When the tilt lever 6 is at the neutral position, the switches 9, 10 are turned off. The switches 9, 10 function as manipulation detectors.

A pressure sensor 11 is located at the bottom of one of the lift cylinders 3. The pressure sensor 11 detects the pressure in the cylinder 3. The sensor 11 thus indirectly detects the weight on the fork 4 based on the pressure and outputs a signal indicating the detected weight.

A battery 12 is located in the body frame and electrically connected to a controller 13 by a line 14. A key switch 15 is located on the line 14. When the key switch 15 is turned on, a current is supplied to the controller 13.

A motor 17 is controlled by the controller 13. The motor 17 is a three-phase alternating current induction motor.

Figure 2:
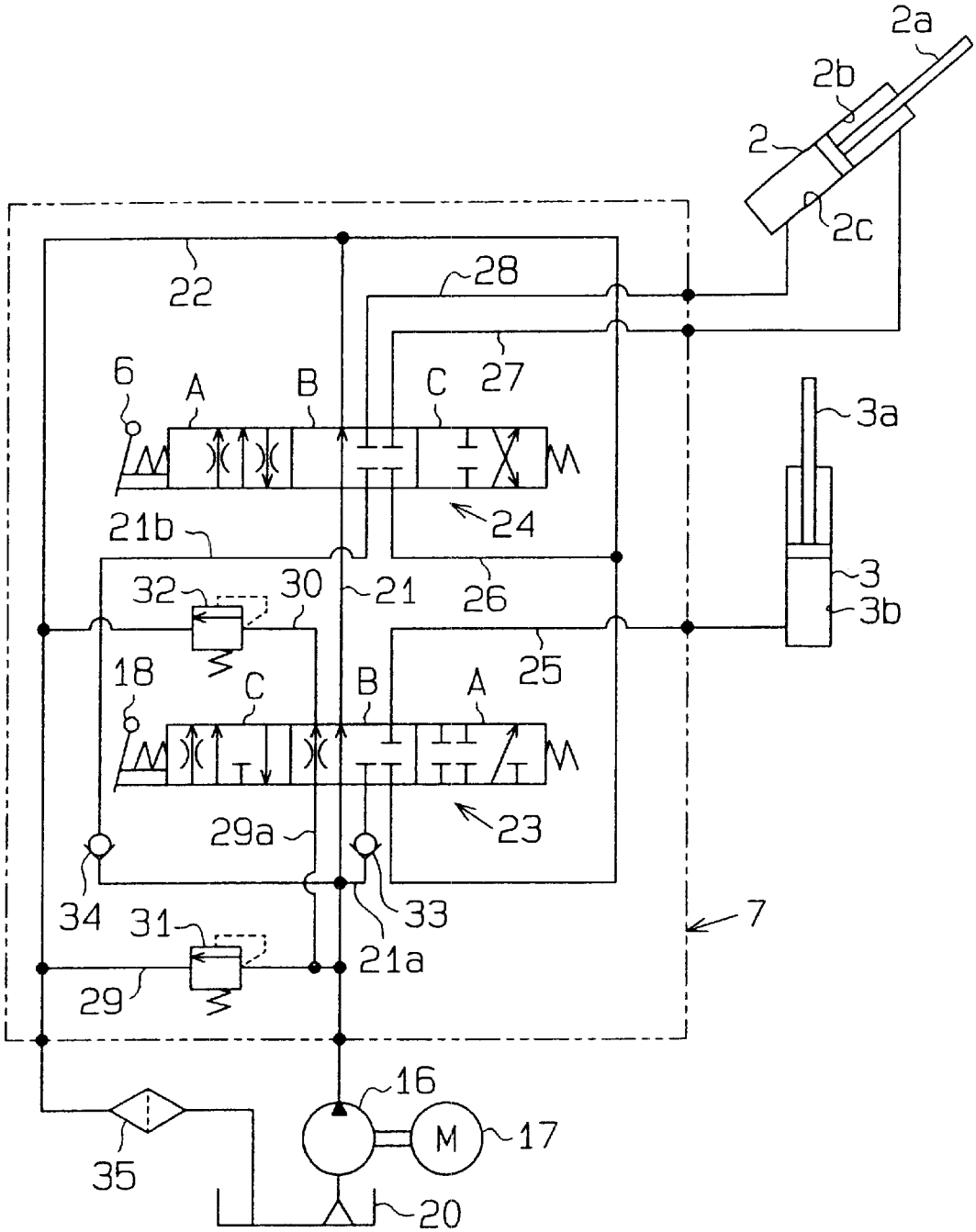
FIG. 2 is a diagram showing a hydraulic circuit of tilt cylinders and lift cylinders.

FIG. 2 illustrates a hydraulic circuit for actuating the tilt cylinders 2 and the lift cylinder 3.

Oil in an oil tank 20 is supplied to the cylinders 2, 3 by a pump 16, which is actuated by the motor 17. A supply pipe 21 is connected to a return pipe 22. The return pipe 22 returns oil from the pump 16 to the oil tank 20. A lift control valve 23 and a tilt control valve 24 are arranged in series in the supply pipe 21.

The lift control valve 23 is a three-way switch valve and includes a spool. The spool of the control valve 23 is mechanically coupled to the lift lever 18. As the lift lever 18 is switched among a lifting position, a neutral position and a lowering position, the spool is moved among a lifting position A for lifting the fork 4, a neutral position B for stopping a vertical movement of the fork 4 and a lowering position C for lowering the fork 4.

The lift control valve 23 is connected to a supply branch pipe 21*a*, the return pipe 22 and a lift pipe 25. The supply branch pipe 21*a* is also connected to the supply pipe 21. The lift pipe 25 is connected to the lift cylinder 3. When the lift control valve 23 is at the lifting position A, the supply branch pipe 21*a* is connected to the lift pipe 25 and oil is supplied to the lift cylinder 3, which extends the lift cylinder 3. When the lift control valve 23 is at the lowering position C, the lift pipe 25 is connected to the return pipe 22, and oil is drained to the oil tank 20 through the lift pipe 25 and the return pipe 22, which retracts the lift cylinder 3. When the lift control valve 23 is at the neutral position B, the lift pipe 25 is disconnected from the pipes 21*a* and 22, which stops vertical movement of the piston rod 3*a*. When the lift control valve 23 is at the lowering position C, oil in a bottom chamber 3*b* of the lift cylinder 3 is drained by the downward force acting on the piston rod 3*a*.

The tilt control valve 24 is a three-way switch valve that has six ports. The valve 24 includes a spool, which is mechanically coupled to the tilt lever 6. As the tilt lever 6 is switched among a forward tilting position, a neutral position and a rearward tilting position, the spool is moved among a forward tilting position A for tilting the mast 1 forward, a neutral position B for stopping a tilting of the mast 1 and a rearward tilting position C for tilting the mast 1 rearward.

The tilt control valve 24 is connected to a supply branch pipe 21*b*, which is connected to the supply pipe 21, a drain branch pipe 26 connected to the return pipe 22, and a first actuation pipe 27, which is connected to a rod chamber 2*b* of each tilt cylinder 2, and a second actuation pipe 28, which is connected to a bottom chamber 2*c* of each tilt cylinder 2.

When the tilt control valve 24 is at the forward tilting position A, the supply branch pipe 21*b* and the second actuation pipe 28 are connected and oil is supplied to the bottom chambers 2*c*. In this state, the first actuation pipe 27 and a drain branch pipe 26 are connected, which drains oil from the rod chambers 2*b* to the oil tank 20. As a result, the tilt cylinders 2 are extended. When the tilt control valve 24 is switched to the rearward tilting position C, the supply branch pipe 21*b* and the first actuation pipe 27 are connected and oil is supplied to the rod chambers 2*b*. In this state, the second actuation pipe 28 and the drain branch pipe 26 are connected, which drains oil from the bottom chambers 2*c* to the oil tank 20. As a result, the tilt cylinders 2 are retracted. When the tilt control valve 24 is at the neutral position B, the actuation pipes 27, 28 are disconnected from the supply branch pipe 21*b* and the drain branch pipe 26, which stops movement of the piston rods 2*a*. The opening size of the tilt control valve 24 is determined by the position of the tilt lever 6. Thus, if the rotating speed of the motor 17 is constant, the tilting speed of the mast 1 is proportional to the degree of manipulation of the tilt lever 6.

A first relief valve 31 is located in a first relief connection pipe 29, which connects the supply pipe 21 to the return pipe 22. A second relief valve 32 is located in a second relief connection pipe 30, which connects the lift control valve 23 to the return pipe 22. The second relief connection pipe 30 is connected to a supply relief pipe 29*a* when the lift control valve 23 is either at the neutral position B or the lowering position C.

When the lift control valve 23 is at the lifting position A and closes the supply pipe 21, the first relief valve 31 releases oil such that the pressure in the lift control valve 23 is equal to a target pressure. When the tilt control valve 24 is at the rearward tilting position C and closes the supply pipe 21, the second relief valve 32 releases oil such that the oil pressure in the circuit is equal to a target pressure. Check valves 33, 34 are located in the supply branch pipe 21*a* to permit oil flow only in one direction. A filter 35 is located on the supply branch pipe 21*a* to remove foreign matter in the oil.

The electric construction of the tilting speed controlling apparatus will now be described.

As shown in FIG. 1, the controller 13 includes a central processing unit (CPU) 51, which is a microcomputer, a read-only memory (ROM) 52, a random access memory (RAM) 53, an input filter 54, an analog-to-digital (A/D) converter 55, a power source circuit 56 and a drive circuit 57. The CPU 51 includes an input port 58 and an output port 59 and connected to a battery 12 by the power source circuit 56. A predetermined voltage, which is adjusted by the power source circuit 56, is applied to the CPU 51.

The height sensor 5, the forward tilt switch 9 and the rearward tilt switch 10 are connected to an input port 58 of the CPU 51 through the input filter 54. The pressure sensor 11 is connected to the input port 58 through the A/D converter 55.

The drive circuit 57 is connected to an output port 59 of the CPU 51 and the battery 12. The drive circuit 57 includes a DC/AC converter, which converts direct current into alternating current. The drive circuit 57 generates a three-phase alternating current from a direct current supplied by the battery 12. The CPU 51 sends a signal for driving the motor 17 to the drive circuit 57. Based on the signal, the drive circuit 57 controls the value and the frequency of the three-phase alternating current supplied to the motor 17. The motor 17 includes a rotational speed sensor (not shown), which is, for example, a rotary encoder, to detect the speed of the motor 17. The rotational speed sensor sends a signal indicating the motor speed to the CPU 51. The CPU 51 feedback controls the motor 17 based on the motor speed signal.

Figure 3:
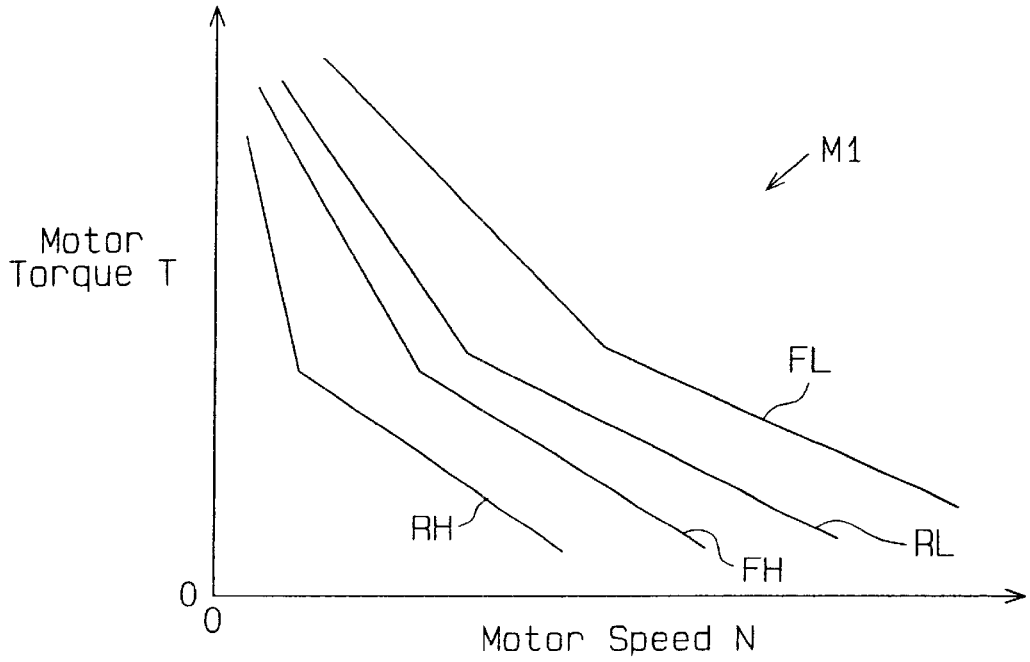
FIG. 3 is a map used for controlling an electric motor.

The ROM 52 stores a tilting speed control program and a map M1 shown in FIG. 3 used for the program. The map M1 has four lines FL, FH, RL and RH and which represent relationships between the motor torque T and the motor speed N. The lines FL, FH, RL and RH represent different combinations of the position of the tilt lever 6 detected by the switches 9, 10 and the height of the fork 4 detected by the height sensor 5. That is, the lines FL, FH, RL and RH represent the combinations of forward tilting and low fork position, forward tilting and high fork position, rearward tilting and low fork position, and rearward tilting and high fork position, respectively. When the tilt lever 6 is at the forward tilting position and the height of the fork 4 is low, the line FL is used. When the tilt lever 6 is at the forward tilting position and the height of the fork 4 is high, the line FH is used. The motor speed is generally set lower on the line FH than on the line FL. When the tilt lever 6 is at the rearward tilting position and the height of the fork 4 is low, the line RL is used. When the tilt lever 6 is at the rearward tilting position and the height of the fork 4 is high, the line RH is used. The motor speed is generally set lower on the line RH than on the line RL.

The lines FL, FH, RL and RH represent four different motor characteristics regarding the motor speed N and the motor torque T. In each line, the motor torque T decreases as the motor speed N increases. When the mast 1 is being tilted forward or rearward and the fork 4 is at a high position, that is, when one of the lines FH, RH is being used, the motor torque T for a given motor speed N is smaller than when the fork 4 is at a low position, that is, when one of the lines FL, RL is being used. When the tilt lever 6 is manipulated to the maximum degree, the tilting speed of the fork 4 is substantially the same when the fork 4 is at the low position and when the fork 4 is at the high position.

The motor torque in the map M1 represents the load on the fork 4. The map M1 therefore shows that, for a given load on the fork 4, the motor speed is smaller when the fork height is in the high range than in the low range.

The operation of the above described tilting speed controlling apparatus will now be described.

When the key switch 15 is turned on, the forklift starts operating. In this state, the motor 17 is actuated when the lift lever 18 is moved to the lifting position or when the tilt lever 6 is manipulated. When the tilt lever 6 is manipulated, the CPU 51 in the controller 13 sends a signal to the drive circuit 57 to actuate the motor 17. When either the forward tilt switch 9 or the rearward tilt switch 10 is on, the CPU 51 judges the height of the fork 4 based on a signal from the height sensor 5. The CPU 51 compares the manipulation direction of the tilt lever 6 and the height of the fork 4 with the map M1 stored in the ROM 52 and selects one of the lines FL, FH, RL, RH from the map M1.

After selecting one of the lines FL, FH, RL, RH, the CPU 51 determines the motor torque T that corresponds to the current motor speed N based on a signal from the motor 17 referring to the map M1. The CPU 51 sends a signal representing the determined motor torque T to the drive circuit 57. The drive circuit 57 controls the motor current and frequency based on the signal from the CPU 51. The motor 17 is thus controlled such that the selected torque-motor characteristics are obtained.

When an object on the fork 4 is relatively heavy, the load on the motor 17 is different from when the object is relatively light. Therefore, the speed of the motor 17 changes in accordance with the weight of the object. That is, motor speed on the map M1 changes in accordance with the weight of the object. For example, when the weight is great, the motor 17 receives a relatively great load, which causes the motor 17 to rotate at a relatively low speed. Accordingly, the tilting speed of the mast 1 is relatively slow. When the weight is small, the motor 17 receives a relatively small load, which causes the motor 17 to rotate at a relatively high speed.

The embodiment of FIGS. 1 to 3 has the following advantages.

(1) If the height of the fork 4 is the same, the tilting speed is decreased for a greater load on the motor 17, or for a heavier object on the fork 4. Therefore, the tilting speed decreases when the center of gravity of the mast 1 rises, which facilitates the tilt control.

(2) When the fork 4 is at a high position, the forward tilting speed and rearward tilting speed of the mast 1 are both limited to a relatively low speed. When the forward tilting motion of the mast 1 is stopped, the rear wheels are prevented from losing contact with the road surface due to excessive inertia. Also, the shock generated when the mast 1 is tilted to the most rearward position is reduced. Further, the speed of the forward tilting and rearward tilting are not unnecessarily reduced, which improves the performance of the forklift.

(3) In addition to whether the center of gravity of the mast 1 is high or low, whether the tilt lever 6 is in the forward tilting position or the rearward tilting position is used as one of the parameters when selecting one of the lines from the map M1. Thus, the tilting speed is optimized.

(4) The embodiment of FIGS. 1 to 3 only requires one additional program for controlling the motor 17 compared to a prior art battery-powered forklift. Thus, the apparatus does not require an electromagnetic valve for controlling the flow rate of oil. Also, the apparatus requires fewer types (number) of sensors for controlling the tilting speed.

The invention may be embodied in the following forms.

Figure 4:
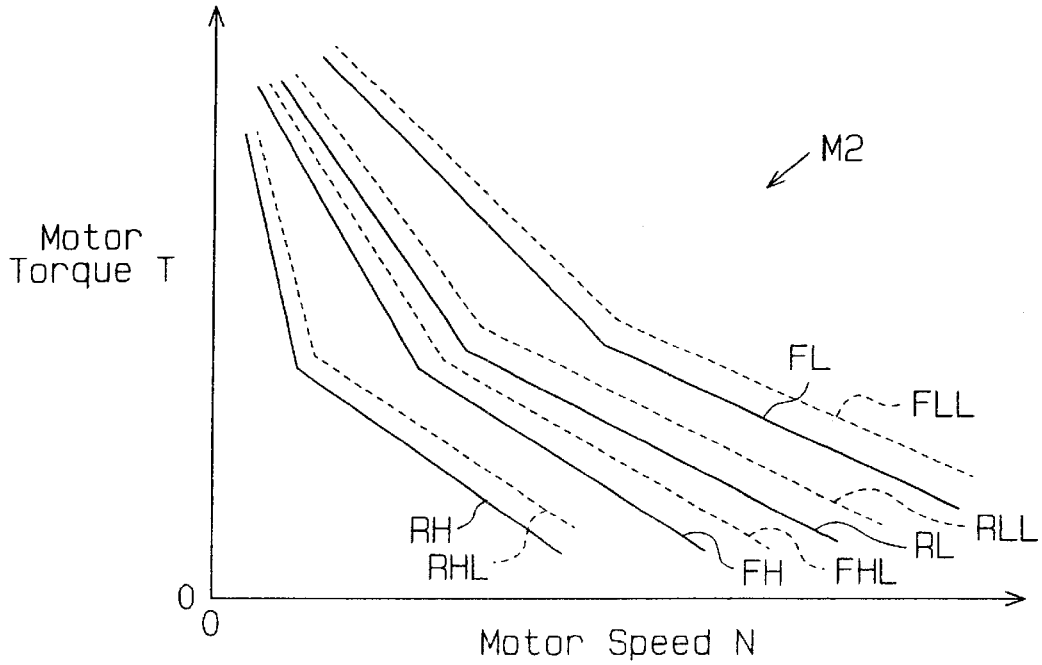
FIG. 4 is a map used for controlling an electric motor according to a second embodiment.

The center of gravity of the mast 1 may be calculated based on the load detected by the pressure sensor 11, and the motor 17 may be controlled according to the height of the fork 4 and the load on the fork 4. A map M2 shown in FIG. 4 has three parameters, that is, the operation direction of the tilt lever 6, the height of the fork 4 and the load on the fork 4, and the map M2 has eight lines. Lines FL, FH, RL, RH are the same as those in the map M1 of FIG. 3 and are used when the weight of the object on the fork 4 is relatively heavy. When the weight of the object is relatively light, lines FLL, FHL, RLL, RHL are used. The lines FLL, FHL, RLL, RHL permit higher motor speeds compared to the lines FL, RL, FH, RH. The motor control characteristics are determined in accordance with the detected weight of the object. The tilting speed is therefore further optimized.

Instead of controlling the motor torque in accordance with the motor speed, the motor speed may be controlled to be constant for a given height of the fork 4. In this case, the motor speed is controlled to be constant when the weight on the fork 4 is zero to a certain value. When the weight is greater than the certain value, the motor speed cannot be maintained. Therefore, even if a map for determining only the motor speed in accordance with the fork height is used, the tilting speed will be lowered for a relatively heavy object on the fork 4.

The operation characteristics of the motor 17 vary according to whether the tilt lever 6 is in the forward tilting position or the rearward tilting position. However, the motor characteristics may be determined regardless of the position of the tilt lever 6. That is, the number of the lines in the map M1 may correspond only to the number of height ranges (for example, the low height range and the high height range) of the fork 4. In this case, to optimize the forward tilting speed and the rearward tilting speed of the mast 1, the structure of the tilt control valve 24 may be adjusted. Specifically, the opening size of the tilt control valve 24 may be changed between when the tilt lever 6 is at the forward tilting position and when the tilt lever 6 is at the rearward tilting position. Alternatively, a throttle may be located in the hydraulic circuit such that that the flow rate of oil changes depending on the operation direction of the tilt lever 6.

Instead of feedback controlling the motor speed, the motor speed may be feed forward controlled. Specifically, the current value and the frequency of the three-phase current supplied to the motor 17 may be determined in accordance with the height of the fork 4. In other words, the CPU 51 outputs a command signal the value of which has one-to-one relationship with the fork height.

In the embodiment of FIGS. 1 to 3, the height sensor 5 detects the height of the fork 4 from two height ranges. However, the height of the fork 4 may be detected from three or more height ranges. Also, the height sensor 5 may be replaced by a height sensor that continuously detects the height of the fork 4.

The motor 17, which is alternating current type, may be replaced by a direct current motor.

The present invention may be embodied in any industrial vehicle that has a load carrier and a tiltable mast.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A tilt speed control apparatus for an industrial vehicle, the apparatus comprising:

a mast pivotally supported on a body frame;

a load carrier supported by the mast, wherein the load carrier is lifted and lowered and is constructed to carry a load;

a tilt cylinder for tilting the mast;

a pump for sending hydraulic oil to the tilt cylinder;

a motor for driving the pump;

an operating member that is actuated to tilt the mast;

an operating detector for detecting that the operating member has been actuated;

a position detector for producing a signal relating to the height of the load carrier;

a controller for controlling the motor, wherein, when the operating detector detects that the operating member has been actuated, the controller controls the motor according to the signal such that the speed of the motor is relatively low when the position of the load carrier is relatively high, wherein the controller stores control data, which represent the relationship between the motor torque and the motor speed in accordance with the position of the carrier, wherein the controller selects data that corresponds to the position detected by the position detector, and the controller controls the motor based on the selected data.

2. The apparatus according to claim 1, wherein the mast pivots frontward and rearward with respect to the body frame, wherein, when the height of the carrier is constant, the controller controls the motor such that the motor speed is different when the mast pivots frontward from when the mast pivots rearward.

3. The apparatus according to claim 1, wherein the position detector detects whether the carrier is in a certain height range.

4. The apparatus according to claim 1, wherein the controller detects the motor speed and controls the motor torque in accordance with the motor speed such that the relationship between the motor speed and the motor torque corresponds to the selected data.

5. The apparatus according to claim 1, wherein the mast pivots frontward and rearward with respect to the body frame, wherein control data include data for frontward tilting and data for rearward tilting, wherein the data for frontward tilting are different from the data for rearward tilting.

6. The apparatus according to claim 1, wherein the apparatus has a weight detector for detecting the weight of the load on the carrier, wherein the controller stores a plurality of control data, which represent the relationship between the motor torque and the motor speed in accordance with the weight on the carrier, wherein the controller selects data that corresponds to the weight detected by the weight detector, and the controller controls the motor based on the selected data.

7. A industrial vehicle comprising:

a mast pivotally supported on a body frame;

a load carrier supported by the mast, wherein the load carrier is lifted and lowered and is constructed to carry a load;

a tilt cylinder for tilting the mast;

a pump for sending hydraulic oil to the tilt cylinder;

a motor for driving the pump, wherein the flow rate of oil sent from the pump depends on the motor speed, and the motor speed is relatively low when the load is relatively heavy;

a position detector for producing a signal relating to the height of the load carrier;

a controller for controlling the motor, wherein, when the mast pivots, the controller controls the motor according to the signal such that the speed of the motor is relatively low when the position of the load carrier is relatively high, wherein the controller stores control data, which represent the relationship between the motor torque and the motor speed in accordance with the position of the carrier, wherein the controller selects data that corresponds to the position detected by the position detector, and the controller controls the motor based on the selected data.

8. The industrial vehicle according to claim 7, wherein the mast pivots frontward and rearward with respect to the body frame, wherein, when the height of the carrier is constant, the controller controls the motor such that the motor speed is different when the mast pivots frontward from when the mast pivots rearward.

9. The industrial vehicle according to claim 7, wherein the position detector detects whether the carrier is in a certain height range.

10. The industrial vehicle according to claim 7, wherein the controller detects the motor speed and controls the motor torque in accordance with the motor speed such that the relationship between the motor speed and the motor torque corresponds to the selected data.

11. The industrial vehicle according to claim 7, wherein the mast pivots frontward and rearward with respect to the body frame, wherein control data include data for frontward tilting and data for rearward tilting, wherein the data for frontward tilting are different from the data for rearward tilting.

12. The industrial vehicle according to claim 7, wherein the apparatus has a weight detector for detecting the weight of the load on the carrier, wherein the controller stores a plurality of control data, which represent the relationship between the motor torque and the motor speed in accordance with the weight on the carrier, wherein the controller selects data that corresponds to the weight detected by the weight detector, and the controller controls the motor based on the selected data.

* * * * *